US009073188B2

(12) United States Patent
Järvi et al.

(10) Patent No.: US 9,073,188 B2
(45) Date of Patent: Jul. 7, 2015

(54) CRIMPING MACHINE SYSTEM

(71) Applicant: LILLBACKA POWERCO OY, Härmä (FI)

(72) Inventors: Jukka Järvi, Mustasaari (FI); Sami Harri, Kauhava (FI)

(73) Assignee: LILLBACKA POWERCO OY, Härmä (FI)

( * ) Notice: Subject to any disclaimer, the term of this patent is extended or adjusted under 35 U.S.C. 154(b) by 0 days.

(21) Appl. No.: 14/186,784

(22) Filed: Feb. 21, 2014

(65) Prior Publication Data

US 2014/0298879 A1 Oct. 9, 2014

(30) Foreign Application Priority Data

Apr. 5, 2013 (EP) ..... 13397507

(51) Int. Cl.
*B21D 39/04* (2006.01)
*B25B 28/00* (2006.01)
*B30B 1/18* (2006.01)

(52) U.S. Cl.
CPC . *B25B 28/00* (2013.01); *B30B 1/18* (2013.01); *B21D 39/046* (2013.01); *B21D 39/048* (2013.01)

(58) Field of Classification Search
CPC .... B21D 39/046; B21D 39/048; H01R 43/04; H01R 43/0585; B30B 1/18; B30B 1/181
USPC ..... 72/370.23, 412, 416, 402, 454, 461; 29/237, 283.5
See application file for complete search history.

(56) References Cited

U.S. PATENT DOCUMENTS

| | | | | |
|---|---|---|---|---|
| 5,257,525 | A * | 11/1993 | Clarke | 72/402 |
| 5,353,623 | A * | 10/1994 | Bobenhausen | 72/402 |
| 5,720,197 | A * | 2/1998 | Grau et al. | 72/402 |
| 5,890,270 | A * | 4/1999 | Oetiker | 72/402 |
| 6,234,000 | B1 * | 5/2001 | Bowling | 72/454 |
| 8,894,035 | B2 * | 11/2014 | Ruelland et al. | 251/8 |

FOREIGN PATENT DOCUMENTS

| | | |
|---|---|---|
| DE | 199 40 744 A1 | 3/2001 |
| DE | 199 58 103 C1 | 3/2001 |
| EP | 2 241 389 A2 | 10/2010 |
| FR | 1 511 418 | 1/1968 |
| WO | WO 01/33675 A1 | 5/2001 |

OTHER PUBLICATIONS

Extended European Search Report issued in European Application No. 13397507.8 dated Jul. 12, 2013.

* cited by examiner

*Primary Examiner* — David B Jones
(74) *Attorney, Agent, or Firm* — Oliff PLC

(57) ABSTRACT

A crimping machine system including a set of crimping jaws placed in a circular array and defining a central axis; a flange structure configured to move in parallel with said central axis; a first power transmitting member equipped with inclined guide surfaces, placed between the jaws and the flange structure, and forcing the jaws to move radially towards the central axis; a circular structure configured to rotate around said central axis; and a second power transmitting member equipped with helical guide surfaces and placed between the circular structure and the flange structure, wherein while the circular structure rotates around the central axis, said power transmitting member is configured to force the flange structure to move in parallel with the central axis.

18 Claims, 6 Drawing Sheets

CRIMPING MACHINE SYSTEM

FIELD OF THE INVENTION

The invention relates to a crimping machine system. In particular, it relates to a crimping machine system which is suitable for connecting hoses and connectors to each other by means of a crimp connection.

BACKGROUND OF THE INVENTION

Crimping machines are used for making various crimp connections and for joining pieces by crimping, in which machines the crimping tool comprises several jaw segments which are placed in a circular array and are movable radially in relation to the work piece to be machined and the centre of the crimping tool. In this description, the term jaw will also be used for referring to a jaw segment.

The piece to be machined by said crimping machine is typically a connector, known as such, which is clamped around a flexible hose to make a tight fitting. Part of the structure of the connector is also fitted inside the hose.

For making the crimp connection, the hose and the connector are joined and placed in an opening in the centre of the crimping machine, after which the jaws are used to perform crimping from several radial directions simultaneously towards the centre of the crimping tool. The number of jaws may be 8 or more, normally an even number, and they are normally placed two by two on opposite sides of the work piece. The jaws normally cover an equal share of the circular shape, and they are normally placed at substantially even intervals on the circle. The crimp connection is based on a deformation of the work piece, whereby the diameter of the outermost part, for example collar, of the connector placed around, for example, a flexible hose is reduced, pressing the hose tightly between an inner part and the outermost part of the connector.

The opposite jaws, as a pair, delimit the minimum and maximum diameter of the opening left between them. The jaws determine the minimum diameter of the opening, when the adjacent jaws are tightly against each other and the radial movement towards the centre of the opening has been completed. With openings larger than this, the jaws can be apart from each other, and it is possible to perform crimping by applying a desired force effect. Several forces, which are preferably equal in magnitude, are effective on the work piece from radial directions and cause the desired deformation, by means of which it is possible to connect different parts of the work piece to each other.

The position of the jaws or the size of the opening is measured either directly or indirectly, in order to know the size of the opening in each situation and at different stages of crimping. The measurement can be taken from a mechanism that moves the jaws, or from an actuator effective on the jaws and said mechanism. This is typically the measurement of the position. During crimping, the size of the opening is monitored, and the crimping is ended after a predetermined opening size or measurement has been achieved. Said predetermined opening size or measurement is selected according to the type of the work piece, the size of the work piece, the materials, or other parameters relating to the work piece or objectives for the crimping process or the desired deformation.

After the crimping process, the work piece is, according to the state of the art, subjected to a verifying measurement, either in a separate measuring device or while the work piece is still in the crimping machine.

The above presented crimping machines can also be used for making corrugations, reductions and other deformations, for example, at the ends of tubes. A crimping machine of prior art for making various crimp connections and for joining pieces by crimping is disclosed in document EP 2 241 389 A2. Another known crimping device is disclosed in WO 01/33675 A1.

The operation of the jaws of the crimping machine is based on various devices. The jaws are functionally coupled to a device that forces the jaws to move simultaneously and in the radial direction. It may be a mechanism in a single piece or in several pieces, comprising wedge-like counter surfaces or guide surfaces or moving in a direction perpendicular to a line extending through the centre of the opening. It may also be an annular or circumferential wedge mechanism based on, for example, one or two cones moving in parallel with the line extending through the centre of the opening. The jaws and the mechanism or device are moved by one or more actuators which are typically cylinder actuators driven by pressurized medium. The actuator exerts a force effect on the work piece by means of the jaws and the mechanism or device.

SUMMARY OF THE INVENTION

The presented solution provides several advantages to previous systems.

The presented solution can be applied as such or as a part of a crimping machine or another crimping machine system. In particular but not solely, it relates to a crimping machine system or a crimping machine which is suitable for connecting hoses and connectors to each other by means of a crimp connection, or for tasks implementing a corresponding deformation.

The crimping machine system according to the presented solution comprises a series of clamping jaws. The jaws are placed in a circular array, they define an opening formed between the jaws and intended for the work piece to be crimped, and for reducing the size of said opening, the jaws are configured to move radially with respect to the central axis defined by the jaws. The crimping machine system also comprises a flange structure configured to move in parallel with the central axis, and a first power transmitting member equipped with inclined guide surfaces and placed between the jaws and the flange structure. As the flange structure moves in parallel with the central axis, said first power transmitting member is configured to force the jaws to move radially towards the central axis. The crimping machine system also comprises a circular structure configured to rotate around said central axis, and a second power transmitting member equipped with helical guide surfaces and placed between the circular structure and the flange structure. As the circular structure rotates around the central axis, said power transmission member is configured to force the flange structure to move in parallel with the central axis.

By means of the presented solution, a compact structure is obtained, particularly if the structures are circular or ring-shaped. Thanks to the compact structure, the work piece has freer access than before between the jaws, and there is more space for the work piece.

As the structure of the crimping machine system is substantially symmetrical, or narrow in the direction of the central axis, thanks to the compact structure, it improves both visibility and usability, wherein the system can be operated from the front as well as from the back and from the sides. Better visibility to the opening is also provided from the side directions.

As the jaws and the work piece are not movable in parallel with the central axis, the work piece can be positioned more easily and precisely between the jaws.

As a power transmission member equipped with helical guide surfaces is used, short movements are achieved in the structure, which is helpful in constructing a compact structure. By means of the helical guide surfaces, a large surface area is also provided, which can be used for transmitting greater forces than by means of point-like or linear contacts.

The use of helical or screw-shaped parts also makes it possible to use rotary motors and simple power transmission members. Consequently, the use of an electrically driven motor is also possible.

In an alternative of the presented solution, the crimping machine system also comprises a second flange structure which is configured to move in parallel with said central axis. Furthermore, the first and second flange structures are configured to move simultaneously towards each other. Furthermore, the crimping machine system comprises a third power transmission member equipped with inclined guide surfaces and placed between the jaws and the second flange structure. As the second flange structure moves in parallel with the central axis, said third power transmitting member is configured to force the jaws to move radially towards the central axis. Furthermore, the crimping machine system comprises a fourth power transmission member equipped with helical guide surfaces and placed between the circular structure and the second flange structure. As the circular structure rotates around the central axis, said fourth power transmission member is configured to force the second flange structure to move in parallel with the central axis.

According to an alternative of the presented solution, the first and/or third power transmission member comprises a guide surface which is placed in said jaws, has a circular shape, and is inclined with respect to the central axis. The first and/or third power transmission member also comprises a second guide surface which is placed in the first or second flange structure, has a circular shape and is inclined with respect to the central axis. The second guide surface is placed against the first guide surface. As the flange structure moves in parallel with the central axis, the second guide surface is configured to slide along the first guide surface and simultaneously to force the jaws to move radially towards the central axis.

According to a particular example, the inclined guide surfaces follow the shape of a cone or a funnel, for example the shape of a right cone. The inclined guide surfaces act as a wedge.

According to an alternative of the presented solution, the second and/or fourth power transmission member comprises a helical guide surface which is placed in the first or second flange structure, and a second helical guide surface which is placed in the circular structure. The second helical guide surface is placed against the first helical guide surface. As the circular structure rotates around the central axis, the second helical guide surface is configured to slide along the first helical guide surface and simultaneously to force the first or second flange structure to move in parallel with the central axis.

According to an example of the presented solution, the helical guide surface is either an external screw thread or an internal screw thread.

According to an example, the crimping machine system further comprises a cogging for driving the circular structure, the cogging having a circular shape and being placed in the circular structure. If necessary, the cogging can also be utilized in a versatile way by various power transmission members and actuators for transmitting or generating power and motion to make the jaws move and exert a force effect on a work piece.

BRIEF DESCRIPTION OF THE DRAWINGS

In the following, the presented solution will be described in more detail with reference to the appended drawings, in which.

MORE DETAILED DESCRIPTION OF THE INVENTION

Figure 1:
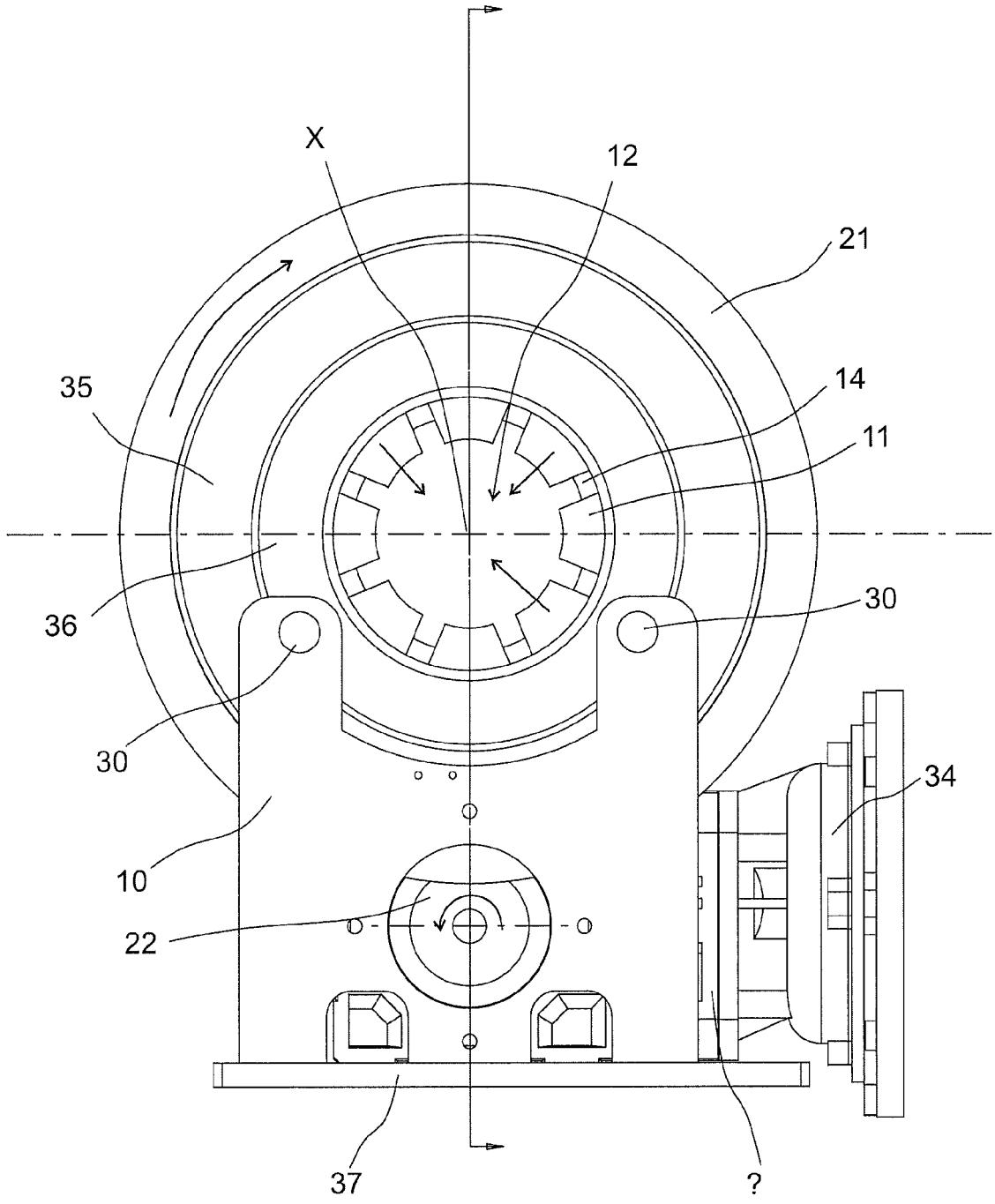
FIG. 1 shows a front view of an example of a crimping machine system applying the presented solution.
Figure 2:
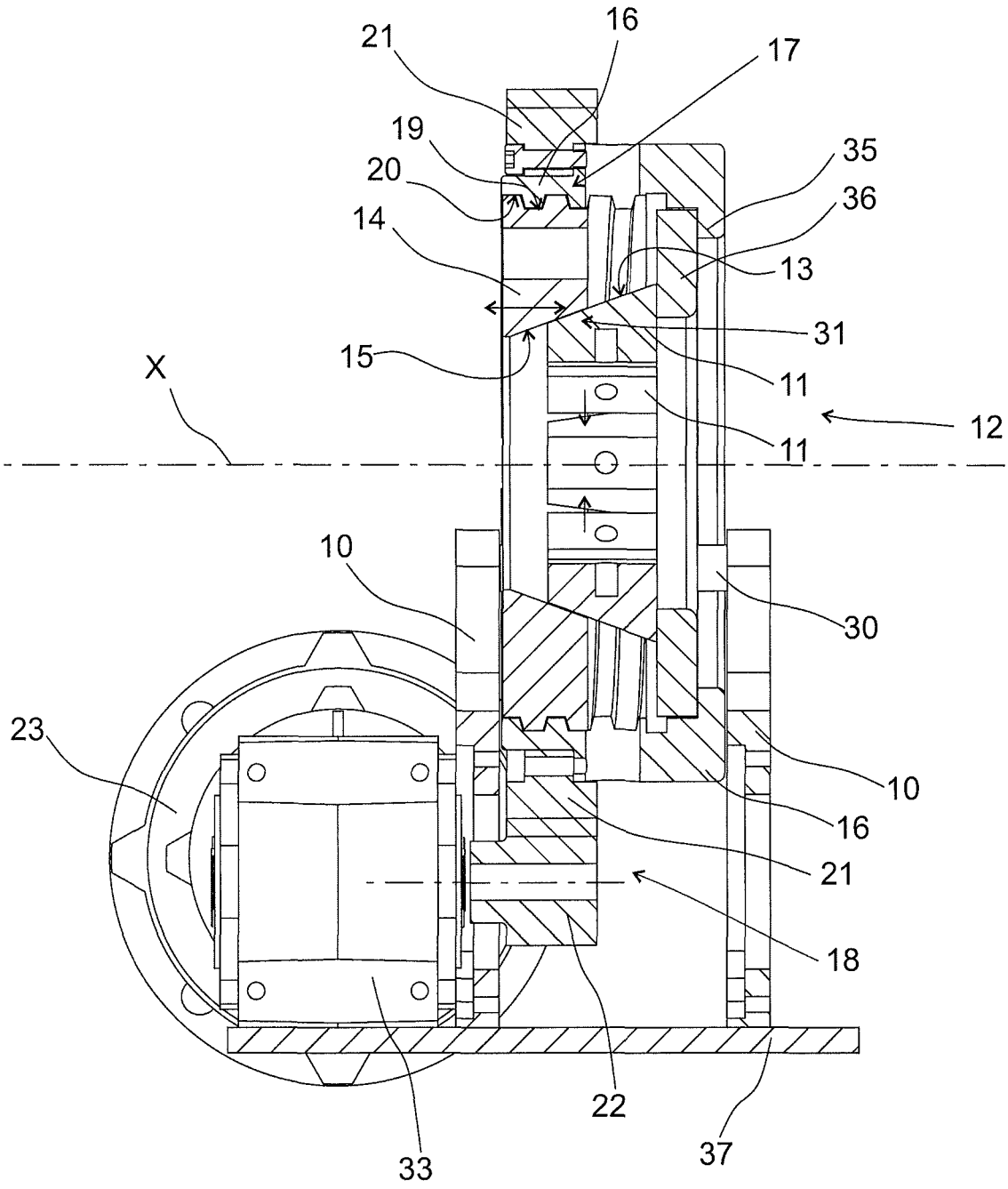
FIG. 2 shows the example of FIG. 1 in a sectional side view.
Figure 7:
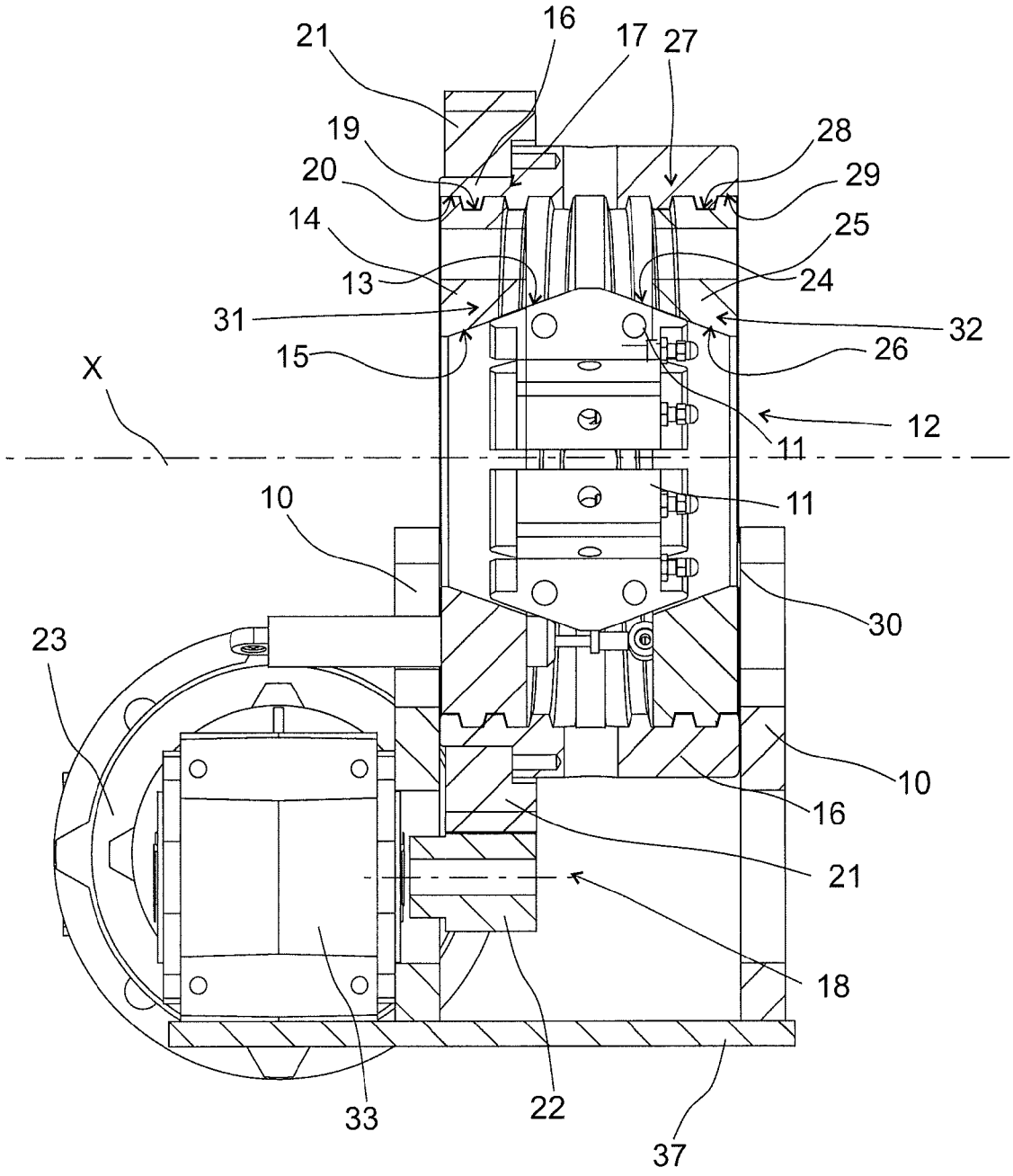
Figure 8:
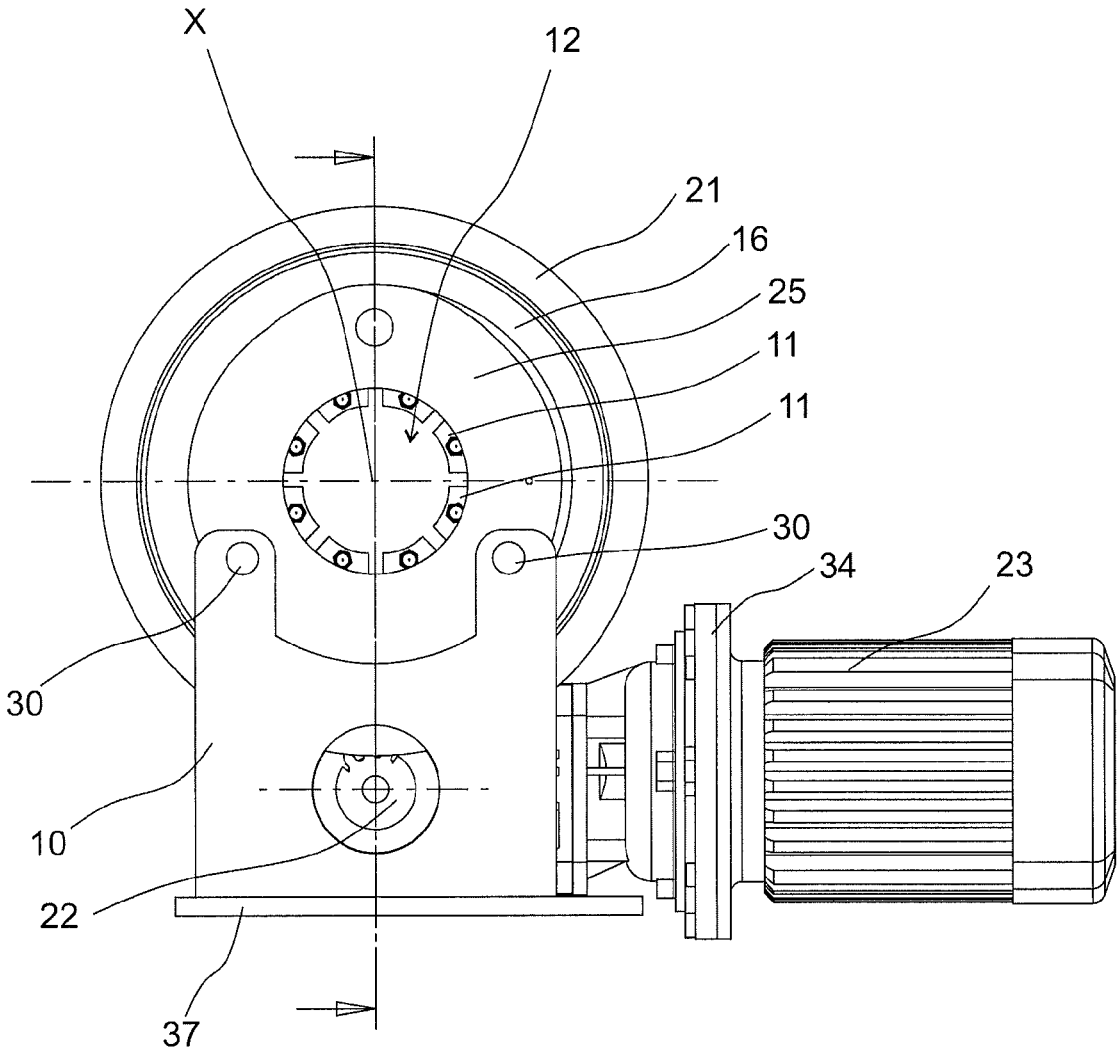
FIG. 8 shows a front view of the example of FIG. 7.

FIGS. 1 and 2, and on the other hand also FIGS. 7 and 8, show two examples of a crimping machine system and a crimping machine in which the solution presented in this description is applied.

In FIGS. 1 to 8, similar parts, or parts intended for similar functions, are denoted with the same reference numeral.

If necessary, the crimping machine system comprises a frame structure 10 on which the other parts of the crimping machine are mounted. The frame structure 10 may comprise fastening members 37 for fastening the crimping machine system to a suitable support or a movable base which may also constitute a part of the crimping machine.

In an example, the frame structure 10 comprises a C or Ushaped structure, inside which at least the circular structure 16 and the flange structure 14 are partly placed. Said parts are held by the frame structure 10, and the frame structure 10 is placed on both sides of the circular structure and the flange structure in such directions that are opposite and parallel to the central axis X. The circular structure 16 and the flange structure 14 extend away from the frame structure 10 and the central axis X, normally above them, when the crimping device is in its use position, and the central axis X is substantially horizontal. The frame structure 10 normally consists of multiple parts and comprises, for example, two vertical sheet structures which are placed on opposite sides of said parts.

The crimping machine system comprises a set of crimping jaws 11. There are 6 to 10 jaws, normally 8 jaws. The work piece is crimped by means of the jaws 11 or auxiliary jaws to be fastened to them. Preferably, the auxiliary jaws are replaceable, wherein various jaws are available for various work pieces. The jaws 11 are stationary in the crimping machine system, or they are replaceable as well.

The jaws 11 are placed in a circular array so that they define, together with the auxiliary jaws, if necessary, an opening 12 formed between the jaws 11 and intended for the work piece to be crimped. The jaws move radially in view of an imaginary central axis X defined by the jaws. The jaws move towards the central axis X for reducing the opening 12 and crimping the work piece. The jaws move in the opposite direction, away from the central axis X, for enlarging the opening 12, for stopping the crimping and for removing the work piece from the crimping machine. The fastening members which are responsible for holding the jaws 11 in the crimping machine system and for their engagement to each other, take care of moving the jaws simultaneously and in the desired direction. The fastening members comprise, for example, spring members placed between the jaws, which members simultaneously tend to move the jaws away from the central axis X.

The crimping machine system further comprises a flange structure 14 which moves in parallel with the central axis X, for example in relation to the frame structure 10. In an example, the rotation of the flange structure 14 with respect to the central axis X is also prevented.

In an example, the flange structure 14 is ring-shaped, and the opening 12 is placed in the centre of the flange structure 14. Preferably, the opening 12 is freely accessible from both sides of the crimping machine system and from such opposite directions which are parallel with the central axis X; that is, from the right and the left in FIG. 2.

In an alternative, the crimping machine system comprises at least one guide member 30 which is fastened to e.g. the frame structure 10 and along which the flange structure 14 can move in parallel with the central axis X. The guide member 30 is preferably stationary with respect to the central axis X, as is the frame structure 10. Furthermore, said guide member 30 prevents the rotation of the flange structure around the central axis X. In an example, the guide member 30 is a pin-like protrusion which is parallel to the central axis X and is placed in a recess or hole in the flange structure. The flange structure is movable, sliding along said protrusion.

The crimping machine system comprises a power transmitting member 31 whose function is to transmit forces from the flange structure 14 to the jaws and to convert the linear movement of the flange structure 14 into a transverse movement of the jaws 11. The flange structure 14 is linearly movable back and forth in the direction of the central axis X.

The power transmitting member 31 is equipped with guide surfaces 13, 15 which follow the shape of e.g. a funnel or a cone, for example such a right cone whose axis coincides with the central axis. The guide surfaces 13, 15 are placed between the jaws 11 and the flange structure 14. For example, the guide surface 13 consists of multiple parts, placed in each jaw 11. In the presented example, the guide surface 15 is a continuous surface placed on the inner surface of the flange structure. In another example, at least the guide surface 15 comprises multiple parts and consists of surfaces placed at each jaw. In a third example, the guide surface 15 consists of several straight planes or surfaces which are placed together in a circular array following the shape of a funnel with multiple sides.

The guide surfaces 13, 15 are placed in such a way with respect to each other that the movement of the flange structure 14, which is parallel with the central axis X and to the right in FIG. 2, forces the jaws 11 to move radially towards the central axis X so that the opening is reduced and the work piece can be subjected to forces by the jaws, also by auxiliary jaws if necessary.

The crimping machine system further comprises a circular structure 16 which rotates around the central axis X, for example in relation to the frame structure 10. In an example, the movement of the circular structure 1 in parallel with the central axis X is also prevented, which is implemented by means of e.g. the frame structure 10. The circular structure 16 is coupled to the flange structure 14 which keeps the circular structure 16 stationary in the direction transverse to the central axis X. For example, the circular structure 16 placed between the frame structure 10 remains stationary in the direction of the central axis X. In an example, the flange structure 16 is ring-shaped, and the opening 12 is placed in the centre of the flange structure 16.

Figure 3:
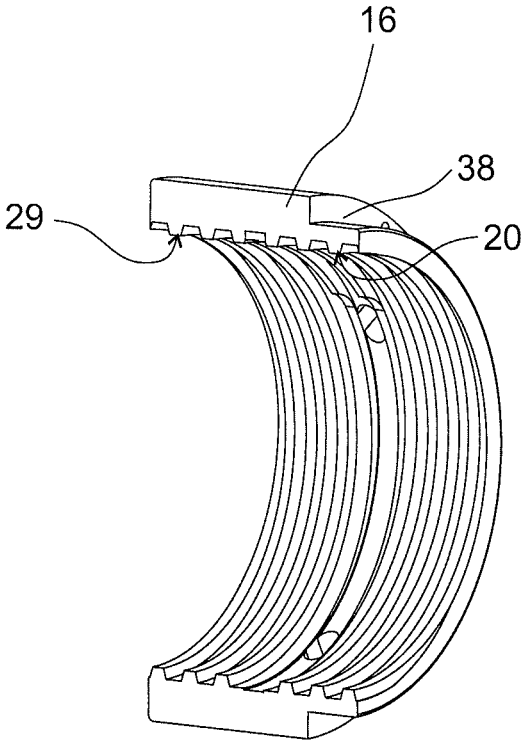
FIG. 3 shows the circular structure of the example of FIG. 7 in a sectional view.
Figure 4:
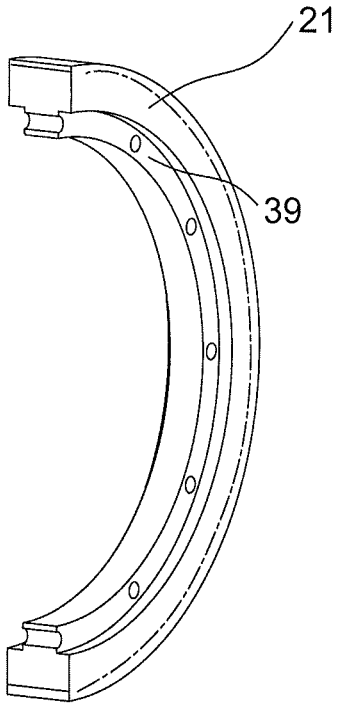
FIG. 4 shows the cogging of the example of FIG. 1 in a sectional view.

As shown in FIG. 3, the circular structure 16 may comprise a structure 38, for example a collar, to which the flange structure 14 can be connected, for example by screws.

In an example, the jaws 11 are supported to a supporting ring 36 in the circular structure 16, preventing the jaws from moving in the direction of the central axis X. The circular structure 16 may comprise several parts, wherein it comprises, for example, several annular parts which are connected to each other for synchronizing the movements. For example, the circular structure comprises a collar 35, against which the supporting ring 36 is placed and which prevents the movement of the supporting ring 36 in the direction of the central axis X. The supporting ring 36 may be an integral part of the circular structure.

The crimping machine system comprises a power transmitting member 17 whose function is to transmit forces from the flange structure 16 to the flange structure 14 and to convert the rotary movement of the flange structure 14 into a linear movement of the flange structure 14. The circular structure 16 is rotatable in opposite directions around the central axis X.

The power transmitting member 17 is equipped with helical guide surfaces 19, 20 which follow the shape of, for example, a spiral whose axis coincides with the central axis. The guide surfaces 19, 20 are placed between the circular structure 16 and the flange structure 14. The guide surfaces are preferably continuous, but for example the guide surface 20 may comprise multiple parts and consist of, for example, successive and helical parts of the guide surface.

The guide surfaces 19, 20 are placed in such a way with respect to each other that the rotation of the circular structure 16 around the central axis X, for example clockwise, forces the flange structure 14 to move in parallel with the central axis X and to the right in FIG. 2. The rotation of the circular structure 16 around the central axis X in the opposite direction, for example counter-clockwise, forces the flange structure 14 to move in the opposite direction in parallel with the central axis X, to the left in FIG. 2. Simultaneously, the jaws 11 can return and move in the opposite direction, that is, radially away from the central axis X.

In an alternative, the power transmitting member 31 comprises a guide surface 13 which has a circular shape and is inclined with respect to the central axis X, to achieve a wedge-like force effect. The guide surface 15 has a circular shape and is inclined with respect to the central axis X. The guide surface 15 is placed against the guide surface 13, so that when the flange structure 14 moves in parallel with the central axis X, the guide surface 15 moves along the guide surface 13 and forces the jaws 11 to move radially towards the central axis X. Simultaneously, the jaws slide against e.g. the frame structure 10 or the supporting ring 36. The inclined shapes of the guide surfaces 13, 15 match each other. In this description, inclined refers, for example, to the fact that an imaginary straight line extending along the guide surface 13, 15 and coinciding with the central axis X is inclined with respect to the central axis X. By the selection of said inclination, the desired wedge effect is achieved.

In an alternative, the force transmitting member 17 has a helical guide surface 19 in the flange structure 14 and a helical guide surface 20 in the circular structure 16. The helical guide surface 20 is placed against the helical guide surface 19 so that when the circular structure 16 rotates around the central axis X, the helical guide surface 20 will slide along the helical guide surface 19 and force the flange structure 14 to move in parallel with the central axis X.

In an alternative, the helical guide surface 19 is an external screw thread in the flange structure, and the helical guide surface 20 is an internal screw thread in the circular structure.

In an example which is also shown in FIG. 2, the circular structure 16 is ring-like, the flange structure 14 is placed inside the circular structure 16, and the helical guide surface 19 is placed on the outer surface of the flange structure 14. The helical guide surface 19 encloses the flange structure 14, and the helical guide surface 20, in turn, is placed on the inner surface of the circular structure 16. The helical guide surface 20 encloses the flange structure 14.

If necessary, the crimping machine system further comprises power transmitting members 18 which are connected to the circular structure 16 and which have the function of transferring force and movement to the circular structure 16, to achieve the movement of the jaws 11 and the crimping of the work piece.

In an example, the circular structure 16 comprises a cogging 21 which has a circular shape and is connected to the circular structure 16. The cogging 21 is used to transmit movement to the circular structure 16, for example by the power transmitting members 18. The cogging 21 may comprise a structure 39, by means of which the cogging is connected to the circular structure 16, for example by screws.

In an example, the power transmission members 18 comprise a cogged wheel 22 which is in a functional contact with the cogging 21, to transmit force and movement from the cogged wheel 22 to the cogging 21. In the presented example, the rotation axis of the cogged wheel is parallel with the central axis X.

In an example, the crimping machine system further comprises an actuator 23 for generating a force and a movement which are transmitted by the power transmitting members 18 to the circular structure 16. Preferably, the actuator is an electrical motor. In another alternative, the actuator is one or more cylinders controlled by pressurized medium, wherein the power transmitting members 18 comprise members, for example joints or fasteners, by means of which the cylinder is connected to the circular structure 16. By means of said power transmitting members, the linear movement of extending or shortening the cylinder is converted to opposite rotary movements of the circular structure 16. In an example, the actuator is a motor operated by pressurized medium.

The motor, e.g. its output shaft, may be provided with a gear 33 for changing the rotation speed of the motor to be suitable for the circular structure 16. Said cogged wheel 22 is coupled to the gear, e.g. its output shaft, or directly to the motor. In another alternative, the gear 23, or the motor, is directly coupled to the circular structure 16 or the cogging 21.

According to another alternative shown in FIGS. 7 and 8, the crimping machine system comprises two flange structures (parts 14 and 25) which operate in opposite directions and whose function corresponds to that of e.g. the flange structure 14. In addition, the crimping machine system comprises two power transmitting members (parts 31 and 32) operating in opposite directions and equipped with guide surfaces, the functions of the members corresponding to the function of e.g. the power transmitting member 31. Said power transmitting members operate together to force the jaws 11 to move towards the centre. In addition, the crimping machine system comprises two power transmitting members (parts 17 and 27) working in opposite directions and equipped with helical guide surfaces, the functions of the members corresponding to the function of e.g. the power transmitting member 17.

In the alternative of FIGS. 7 and 8, the flange structures 14, 25 move simultaneously either towards or away from each other, controlled by the circular structure 16. The circular structure 16 is, for example, similar to that shown in FIG. 3. The circular structure 16 may comprise several parts, wherein it comprises, for example, several adjacent annular parts which are connected to each other for synchronizing the movements. In the alternative of FIG. 7, the left and right parts of the circular structure 16 may consist of two annular parts, each equipped with the necessary power transmitting members.

The crimping machine system comprises a flange structure 25 in which it is possible to apply the examples, functions and features which have been described above in connection with the flange structure 14. The crimping machine system comprises a power transmitting member 32 equipped with guide surfaces 24, 26 having the shape of a funnel or a cone and being placed between the jaws 11 and the flange structure 25, and in which it is possible to apply the examples, features and functions which have been described above in connection with the power transmitting member 31. The crimping machine system comprises a power transmitting member 27 equipped with helical guide surfaces 28, 29 and being placed between the circular structure 16 and the flange structure 25, and in which it is possible to apply the examples, features and functions which have been described above in connection with the power transmitting member 17.

Figure 5:
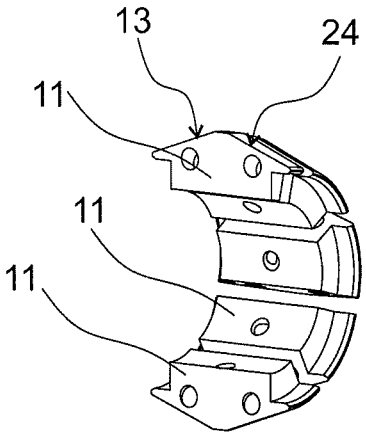
FIG. 5 shows the set of jaws of the example of FIG. 7 in a sectional view.
Figure 6:
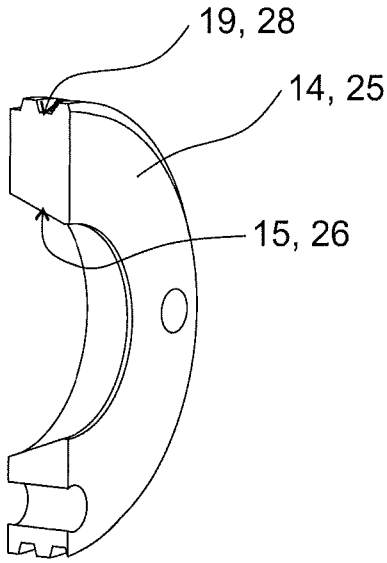
FIG. 6 shows the flange structure of the example of FIG. 1 or FIG. 7 in a sectional view and FIG. 7 shows a sectional side view of another example of a crimping machine system applying the presented solution.

In an example, the power transmitting member 32 comprises a guide surface 24 which is placed in the jaws 11. In the guide surface 24, it is possible to apply the examples, features and functions which have been described above in connection with the guide surface 13. The guide surface 24 is inclined with respect to both the central axis X and the guide surface 13. As shown in FIG. 5, a ridge is formed between the guide surfaces 13, 24 in each jaw 11 and, in turn, placed between the flange structures 14, 25. The space between the flange structures 14, 25 is configured such that they can move towards each other and simultaneously move the jaws.

The power transmitting member 32 further comprises a guide surface 26 in the flange structure 25. In the guide surface 26, it is possible to apply the examples, features and functions which have been described above in connection with the guide surface 15.

In an example, the power transmitting member 27 comprises a helical guide surface 28 in the flange structure 25, having an opposite direction of rotation with respect to the helical guide surface 19, as shown in FIGS. 3 and 7. In the helical guide surface 28, it is possible to apply the examples, features and functions which have been described above in connection with the helical guide surface 19. The power transmitting member 27 further comprises a helical guide surface 29 in the circular structure 16, having an opposite direction of rotation with respect to the helical guide surface 20. The helical guide surface 29 is placed against the helical guide surface 28. In the helical guide surface 29, it is possible to apply the examples, features and functions which have been described above in connection with the helical guide surface 20.

The operation of the crimping machine system may be controlled by e.g. a separate control system. The control system is partly based on components known as such, for example programmable control devices which control e.g. an actuator and the direction of movement of the actuator, or stop the actuator, when necessary. By means of the control system, the crimping machine is controlled to perform desired operations and various crimping cycles. Typically, the crimping machine system comprises sensors for monitoring the position of the jaws either directly or indirectly. In addition, it is possible to monitor the force exerted by the jaws on the work piece, for example by monitoring the pressure of an actuator or the current and by estimating said force on the basis of it.

The presented solutions are not limited in any way to the above presented alternatives and examples only. The above presented functions, structures and features can be combined in a desired away in a crimping machine system or a crimping machine applying the above presented solution, and the same also applies to the above described inclined or threaded power transmitting members and inclined or helical guide surfaces. For example, the crimping machine system may comprise several adjacent coggings 21 engaged to one or more parts of the circular structure. Several cogged wheels 22, each rotating a single cogging, may be coupled to the motor 23 or the gear 33.

Consequently, the invention is not restricted solely to the alternatives and examples presented above, but it may vary in accordance with the appended claims.

The invention claimed is:

1. A crimping machine system comprising:

a set of jaws having at least four jaws, the set of jaws being placed in a circular array, defining a central opening formed by the set of jaws and intended for a work piece to be crimped, wherein said set of jaws is adapted to move radially with respect to the opening and a central axis defined by the set of jaws, a flange structure adapted to move axially with respect to said set of jaws in a direction parallel with said central axis, a first power transmitting member equipped with inclined guide surfaces and placed between the set of jaws and the flange structure, wherein when the flange structure moves axially with respect to said set of jaws and in the direction parallel with the central axis, said first power transmitting member is adapted to force the set of jaws to move radially with respect to the opening and towards a center of the opening and the central axis, a circular structure adapted to rotate around said flange structure and said central axis, and a second power transmitting member equipped with helical guide surfaces and placed between the circular structure and the flange structure, wherein when the circular structure rotates around the flange structure and the central axis, said second power transmitting member is adapted to force the flange structure to move axially with respect to said set of jaws in the direction parallel with the central axis.

2. The crimping machine system according to claim 1, wherein the first power transmitting member comprises:

a first inclined guide surface placed in said set of jaws and having a circular shape, and a second inclined guide surface placed in said flange structure and having a circular shape, wherein the second inclined guide surface is placed against the first inclined guide surface, and while the flange structure moves axially with respect to said set of jaws and in parallel with the central axis, the second inclined guide surface is adapted to slide along the first inclined guide surface and simultaneously to force the set of jaws to move radially with respect to the opening and towards the center of the opening and the central axis.

3. The crimping machine system according to claim 2, wherein the second power transmitting member comprises:

a first helical guide surface placed in the flange structure, and a second helical guide surface placed in the circular structure, wherein the second helical guide surface is placed against the first helical guide surface, and while the circular structure rotates around the flange structure and the central axis, the second helical guide surface is adapted to slide along the first helical guide surface and simultaneously to force the flange structure to move axially with respect to said set of jaws and in parallel with the central axis.

4. The crimping machine system according to claim 3, wherein the first helical guide surface is an external screw thread and the second helical guide surface is an internal screw thread.

5. The crimping machine system according to claim 1, wherein the second power transmitting member comprises:

a first helical guide surface placed in the flange structure, and a second helical guide surface placed in the circular structure, wherein the second helical guide surface is placed against the first helical guide surface, and while the circular structure rotates around the flange structure and the central axis, the second helical guide surface is adapted to slide along the first helical guide surface and simultaneously to force the flange structure to move axially with respect to said set of jaws and in parallel with the central axis.

6. The crimping machine system according to claim 5, wherein the first helical guide surface is an external screw thread and the second helical guide surface is an internal screw thread.

7. The crimping machine system according to claim 1, wherein the circular structure is ring-shaped, the flange structure is placed inside said circular structure, and the first helical guide surface is placed on the outer surface of the flange structure in such a way that the first helical guide surface encloses the flange structure, and further the second helical guide surface is placed on the inner surface of the circular structure in such a way that second helical guide surface encloses the flange structure.

8. The crimping machine system according to claim 1, wherein the crimping machine system further comprises a cogging for driving the circular structure, wherein the cogging has a circular shape and is placed in the circular structure.

9. The crimping machine system according to claim 1, wherein the crimping machine system further comprises power transmitting members adapted to transfer power and movement to the circular structure, for moving the set of jaws and crimping the work piece.

10. The crimping machine system according to claim 1, wherein the crimping machine system further comprises an actuator adapted to generate power and movement to be transmitted to the circular structure, wherein the actuator is an electrical motor.

11. The crimping machine system according to claim 1, wherein the crimping machine system further comprises:

a second flange structure adapted to move axially with respect to said set of jaws in a direction parallel with said central axis, wherein the first and second flange structures are further adapted to move simultaneously towards each other, a third power transmitting member equipped with inclined guide surfaces and placed between the set of jaws and the second flange structure, wherein while the second flange structure moves axially with respect to said set of jaws and in the direction parallel with the central axis, said third power transmitting member is adapted to force the set of jaws to move radially with respect to the opening and towards the center of the opening and the central axis, a fourth power transmitting member equipped with helical guide surfaces and placed between the circular structure and the second flange structure, wherein while the circular structure rotates around the second flange structure and the and the central axis, said fourth power transmitting member is adapted to force the second flange structure to move axially with respect to said set of jaws in the direction parallel with the central axis.

12. The crimping machine system according to claim 11, wherein the third power transmitting member comprises:

a third inclined guide surface placed in said set of jaws, having a circular shape and being inclined with respect to the first inclined guide surface, and a fourth inclined guide surface placed in said second flange structure and having a circular shape, wherein the fourth inclined guide surface is placed against the third inclined guide surface, and while the second flange structure moves axially with respect to said set of jaws and in parallel with the central axis, the fourth inclined guide surface is adapted to slide along the third inclined guide surface and simultaneously to force the set of jaws to move radially with respect to the opening and towards the center of the opening and the central axis.

13. The crimping machine system according to claim 12, wherein the fourth power transmitting member comprises:

a third helical guide surface placed in the second flange structure and having an opposite direction of rotation with respect to the first helical guide surface, and a fourth helical guide surface placed in the circular structure and having an opposite direction of rotation with respect to the second helical guide surface, wherein the fourth helical guide surface is placed against the third helical guide surface, and while the circular structure rotates around the second flange structure and the central axis, the fourth helical guide surface is adapted to slide along the third helical guide surface and simultaneously to force the second flange structure to move axially with respect to said set of jaws and in parallel with the central axis.

14. The crimping machine system according to claim 11, wherein the fourth power transmitting member comprises:

a third helical guide surface placed in the second flange structure and having an opposite direction of rotation with respect to the first helical guide surface, and a fourth helical guide surface placed in the circular structure and having an opposite direction of rotation with respect to the second helical guide surface, wherein the fourth helical guide surface is placed against the third helical guide surface, and while the circular structure rotates around the second flange structure and the central axis, the fourth helical guide surface is adapted to slide along the third helical guide surface and simultaneously to force the second flange structure to move axially with respect to said set of jaws and in parallel with the central axis.

15. The crimping machine system according to claim 1, wherein the crimping machine system further comprises at least one guide member, along which the flange structure is movable axially with respect to said set of jaws and in parallel with the central axis, and further said at least one guide member is adapted to prevent rotation of said flange structure around said set of jaws and said central axis.

16. The crimping machine system according to claim 1, wherein, when the circular structure rotates in an opposite direction around the flange structure and the central axis, the first power transmitting member is adapted to force the flange structure to move axially in an opposite direction with respect to said set of jaws and to allow the set of jaws to move in an opposite direction radially with respect to the opening and away from the center of the opening and the central axis.

17. The crimping machine system according to claim 1, wherein the circular structure or the flange structure, or both of them, are ring-shaped, and said opening is freely accessible from two opposite sides of the crimping machine system.

18. The crimping machine system according to claim 1, wherein the crimping machine system further comprises a frame structure having a C- and U-shaped structure, wherein the flange structure and the circular structure are movable with respect to the frame structure, wherein at least the circular structure and the flange structure are partly placed inside the frame, and wherein the frame structure is placed on two opposite sides of said circular structure and flange structure.

* * * * *